US010301162B2

(12) United States Patent
Nini

(10) Patent No.: US 10,301,162 B2
(45) Date of Patent: May 28, 2019

(54) DELIVERING TAP FOR CARBONATED BEVERAGES EQUIPPED WITH FORGERY-PREVENTING SYSTEM AND WARRANTY SEAL WITH INTEGRATED DEGASSING KEY, AND VESSEL FOR CARBONATED BEVERAGES EQUIPPED WITH SUCH TAP

(71) Applicant: Vitop Moulding S.R.L., Alessandria (IT)

(72) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 0 days.

(21) Appl. No.: 15/553,141

(22) PCT Filed: Feb. 18, 2016

(86) PCT No.: PCT/IT2016/000042
§ 371 (c)(1),
(2) Date: Aug. 23, 2017

(87) PCT Pub. No.: WO2016/135763
PCT Pub. Date: Sep. 1, 2016

(65) Prior Publication Data

US 2018/0072554 A1 Mar. 15, 2018

(30) Foreign Application Priority Data

Feb. 23, 2015 (IT) ..... TO2015A0119

(51) Int. Cl.
*B67D 1/00* (2006.01)
*B67D 1/04* (2006.01)
*B67D 1/08* (2006.01)

(52) U.S. Cl.
CPC ..... *B67D 1/0406* (2013.01); *B67D 1/0004* (2013.01); *B67D 1/0804* (2013.01);
(Continued)

(58) Field of Classification Search
CPC .. B67D 1/0829; B67D 1/0406; B67D 1/0004; B67D 1/0804; B67D 1/0831;
(Continued)

(56) References Cited

U.S. PATENT DOCUMENTS 4,000,829 A * 1/1977 Johnson, Jr. ..... B65D 47/32
174/153 G
4,134,522 A * 1/1979 Patzke ..... G03D 7/00
222/153.14

(Continued)

FOREIGN PATENT DOCUMENTS

EP 2829505 A1 1/2015

*Primary Examiner* — Frederick C Nicolas
(74) *Attorney, Agent, or Firm* — Jeffrey G. Sheldon; Cislo & Thomas LLP

(57) ABSTRACT

A delivering tap made of plastic for a vessel for liquids, the delivering tap having a main body, at least one cover coupled to the main body, the cover having a first turret for gas entering the vessel and a second turret for liquid exiting the vessel, each turret having a turret bottom operatively threadedly coupled to its respective turret body, a first piston located inside the first turret, a second piston located inside the second turret, each piston configured to control an opening of one of the turrets simultaneously with a closing of the other turret, an insulating sealing O-ring for each turret bottom for separating passage of gas from passage of liquid, a spring disposed in each turret bottom to push the corresponding piston to a closed position, at least one tamper seal to indicate external access to the turrets, and at least one degassing key.

17 Claims, 16 Drawing Sheets

(52) U.S. Cl.
CPC ..... *B67D 1/0831* (2013.01); *B67D 1/0847* (2013.01); *B67D 1/0851* (2013.01); *B67D 1/0829* (2013.01); *B67D 2001/0098* (2013.01); *B67D 2001/0824* (2013.01)

(58) Field of Classification Search
CPC ..... B67D 1/0847; B67D 1/0851; B67D 2001/0098; B67D 2001/0824
See application file for complete search history.

(56) References Cited

U.S. PATENT DOCUMENTS

| | | | | | |
|---|---|---|---|---|---|
| 4,699,298 | A | * | 10/1987 | Grant | B67D 1/0829 222/400.7 |
| 4,784,299 | A | | 11/1988 | Stenger | |
| 5,025,955 | A | * | 6/1991 | Stenger | B67B 7/26 222/400.8 |
| 5,094,365 | A | * | 3/1992 | Dorfman | B67D 1/0829 137/212 |
| 5,836,483 | A | * | 11/1998 | Disel | B08B 9/0325 222/396 |
| 9,567,200 | B2 | * | 2/2017 | Eriksson | C12C 11/006 |
| 2017/0158484 | A1 | * | 6/2017 | Lehman | B67D 1/0406 |

* cited by examiner

DELIVERING TAP FOR CARBONATED BEVERAGES EQUIPPED WITH FORGERY-PREVENTING SYSTEM AND WARRANTY SEAL WITH INTEGRATED DEGASSING KEY, AND VESSEL FOR CARBONATED BEVERAGES EQUIPPED WITH SUCH TAP

CROSS-REFERENCE TO RELATED APPLICATIONS

The present Application is a national stage of International Patent Application No. PCT/IT2016/000042, titled "Delivering Tap for Carbonated Beverages Equipped With Forgery-Preventing System and Warranty Seal With Integrated Degassing Key and Vessel for Carbonated Beverage Equipped With Such Tap," filed Feb. 18, 2016, which claims priority from Italian Patent Application No. TO2015A000119 filed Feb. 23, 2015, the contents of which are incorporated herein by reference in their entirety.

BACKGROUND ART

The study of the new plastic closure (and of the particular geometry of the neck of the associated vessel), which is wholly recyclable, has started from the analysis of the system nowadays on the market, called in particular "Cornelius keg".

The Cornelius kegs of the IMI Cornelius Company have been and are uncontested market leaders.

The Cornelius kegs (also known as "soda kegs" or "pepsi kegs") are a particular type of barrel used for dispensing soft drinks and draft beverages.

The main features of this barrel are:

- its slim shape, which allows inserting many barrels inside a refrigerator;
- its opening with wide mouth, which allows also manually performing the internal cleaning of the barrel;
- its reduced capacity, about 18 liters (or 5 gallons) for the bigger ones and about 9 liters (or 3 gallons) for the smaller ones.

Actually, these barrels are divided into two categories, according to the type of connection: "ball lock" (or Jolly) and "pin lock".

The "Cornelius keg" has a very simple operation.

The keg head, which is made of steel/aluminium, is equipped with a main trap useful for the internal washing of the vessel, and with two connections (which can be, as stated above, "ball lock" or "pin lock"). One operates as entry for gas (where CO2 or nitrogen can be inserted) and the other one as outlet for liquid.

A dip tube is always connected (inside the vessel) to the liquid outlet, such tube collecting the liquid pushed by the pressure on the bottom, in order to enable completely emptying the keg.

This type of vessel however has various problems:

- the Cornelius keg is re-usable and very costly and has no forgery-preventing systems which protect the beverage inside it;
- the barrels are composed of many costly parts (some need a replacement after every use);
- the Cornelius kegs can be re-filled, since their closures has no forgery-preventing systems, and therefore products (beverages) not certified by the manufacturers could sometimes be put on the market;

- being re-usable, the vessel must necessarily go back, after their use, to the filling centre to be washed and sanitized;
- the consumer must pay a high amount as caution of the vessel when he purchases the beverage in these kegs;
- also for the manufacturer, the cost is high, because he will have to support expenses for transporting the filled vessel, but also for taking back the empty vessel to his company;
- moreover, the management and washing costs are also born by the end user;
- at "carbon footprint" and ecologic level, the Cornelius keg has a heavy impact on the environment, two to its transport (of a filled barrel and the return of the empty barrel) and washing (with great uses of water and disinfectant);
- the Cornelius keg has several pieces which must necessarily be replaced at the end of every use (since the Cornelius keg, as previously stated, is re-usable, obviously after washing and sterilization);
- the pieces which are normally exchanged upon every use are: CO2 pipe, internal valve, O-ring 8.4 Jolly, O-ring 8.4 pipe, red taps for handle, Jolly connections, safety valve, O-ring 8.4 cover. All these components have O-rings 8.4 and small springs inside them; the elastic and mechanical properties of these components, with their use, and with time, can worsen and thereby impair their pressure seal;
- moreover, a normally used barrel has the gaskets used for the previously contained product, which therefore could modify the taste of the beverage inserted afterwards; an exchange of the O-rings 8.4 is compulsory to have always clean and efficient barrels. the Cornelius kegs, being re-usable, must necessarily go back to the filling centre, must be disassembled and sterilized, and moreover it is necessary to change all O-rings 8.4: therefore, high management costs will occur both for the filled barrel, and for the used "return" barrel; there is a single warranty seal (which is also a protection of the two connections from dirt and dust): it is a big-sized tap which covers the area of the two connections and is fastened with a warranty strap/seal only after its filling. Once having removed the tap (after its first use), if stored, it can be re-used by a possible counterfeiter (after he has filled again the keg with a different product), and again blocked with a new strap, certifying, with the same "regenerated" warranty seal with a new blocking strap, actually a non-original product;
- since there are no recognition signs on the keg body, it is not easy, above all for the end user, to discriminate at first sight the gas connection from the liquid connection: many times the connections are reversed and therefore the system does not work and is blocked, thereby requiring the assistance intervention (additional costs).

SUMMARY OF THE INVENTION

Object of the present invention is solving he above prior art problems, by providing a delivering tap for barrel-type vessels made of PET developed by the market as an eco-friendly, economic alternative, to metallic barrels for draft beverages.

Such barrel-type beverage vessels are lightweight, made of recyclable PET, which has been designed for a unidirectional use, and therefore do not need their withdrawal for washing and filling them again: at the end of their use, they are dispensed with in the plastic recycling container.

The barrel is usually available with unidirectional, low cost taps, which allow being placed to existing draft systems, for example for draft beers.

The keg made of PET offers a meaningful solution in the sale and marketing of volumes of beer, wine and other beverages.

It opens new channels and markets and provides a change of attitude in environmental performances—as well as reducing the costs and improving the cash flow.

The advantages of the keg made of PET with respect to metal barrels include the total property costs, reduced environmental impact, new market opportunities and easier short-term response as regards demand peaks and depressions.

There is potentially a big saving in invested capital, removing the need of keeping a 'fleet' of metallic barrels.

Removing the fleet, the high sums linked to this 'good' can be freed and the constant expenses of replacing damaged, lost or stolen barrels can be removed.

Moreover, there is no more the need of keeping the costly tracing systems for metallic kegs.

The environmental benefits of the keg made of PET include: low use of materials, with respect to disposable metallic barrels and other unidirectional barrels, and a lightweight construction which reduced the environmental impacts.

Moreover, there is a higher flexibility in the choice of the liters of liquid to be transported (nowadays the liters are fixed and established).

The kegs made of PET are completely and easily recyclable, satisfy all essential requirements covered by Community regulations, among which suitability both for mechanics, and for recycling "waste energy".

Using barrels made of PET, real benefits for end users are obtained.

One of the biggest advantages is the reduced storage space necessary for the PET barrels: safely storing empty metallic barrels to prevent them from being stolen before being collected is a problem in many sales points.

As already previously stated, the kegs made of PET can be easily squashed once they are empty, to place them afterwards in a basket with other recyclable plastic materials.

These PET kegs, in order to comply with the above mentioned features imposed by the market, need a connecting tap which can be adapted to existing draft systems present in bars and in restaurants, etc., which is compatible with the PEG kegs (therefore made of recyclable plastic, etc.).

Usually, the connection/delivery tap is connected by engagement, screwing on a thread and/or sometimes also welded (thermally or with ultrasounds).

The delivering tap can have different types of connections depending on the delivered product, or on dispensers to which it will be addressed: the known and widest types of connections are types D, S, A, G, U and M.

Currently, in the market of PET kegs, there are many proposals as regards practically all above-listed types of connections, proposals set forth, for example, by the Companies PETAINER, KEYKEG or POLYKEG, but there is no plastic tap, apart from the one disclosed in EP-A-2829505, of the same Applicant of the present Application, dedicated to a unidirectional use, which synthesizes in a single solution a closure with double connection with two turrets of the Cornelius type, used for example for the products of the PEPSICO Company, with two separate connecting turrets, one for gas (as entry) and one for liquid (as outlet).

And above all there is no tap with two turrets of the Cornelius type which has solved all the above mentioned problems.

A further object of the present invention is solving the above problems, by providing a delivering tap with double turret of the Cornelius style (with the chance of having both the connection of the pin lock type, and the connection of the ball lock type, and also connections with a specific geometry for PEPSICO products for the so-called JOLLY valve and the so-called NC valve) which is equipped with warranty seals which state the non-authorized opening, with a geometry, integrated on the seal itself, which will allow degassing the vessel (and therefore discharging it from its internal pressure and giving the chance of disassembling the vessel for an adequate recycle in containers for plastics and the like), and with forgery-preventing means, which prevent the vessel from being re-opened for a second, unauthorized filling (unless the tap is destroyed), and that is equipped at the same time with a main head (with the two connecting turrets) made in a single piece, but which is different from the main screwing body, in order to also provide the chance of differentiating the used plastic materials and allow using, for the main piece, the piece which will then perform the real liquid seal, possibly a material with high oxygen barrier. The tap will be recyclable and thereby eco-friendly.

A further object of the present invention is providing a tap as stated above in which a closure is created reducing (and simplifying the geometry in order to have an injection mould which produces the very simple and therefore more economic part) the number of pieces, simplifying its assembling and the related final cost with respect to the existing solution of the aluminium keg.

A further object of the present invention is providing a tap as stated above which has an immediate (aesthetic and geometric) system for locating the two connections for liquid and gas, by the end user and the filling centre.

A further object of the present invention is possibly providing the bottle neck with particular internal elements (geometries) which, coupled with the elements (geometries) being present (possibly if requested) on the tap, will make the tap unscrewable and therefore not reusable a second time (forgery-preventing tap+forgery-preventing means present on the neck of the vessel (also called herein below "carafe")).

A further object is having integrated on the warranty seal, which will be inserted on the tap once having filled the vessel with liquid for safeguarding the integrity and the originality of the product contained inside, a key for degassing the barrel (at the end of its life, in order to be able to bend, disassemble and recycle it in suitable containers, dividing plastics and metal of internal springs). On the marketed barrels, such key is a very costly accessory sold apart.

The above and other objects and advantages of the invention, as will result from the following description, are obtained with a delivering tap and a vessel equipped with such tap as claimed in the respective independent claims.

Preferred embodiments and non-trivial variations of the present invention are the subject matter of the dependent claims.

It is intended that all enclosed claims are an integral part of the present description.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

With reference to the Figures, a preferred embodiment of the tap 1 of the present invention is shown and described. It will be immediately obvious that numerous variations (for example related to shape, sizes and parts with equivalent functionalities) could be made to the described tap 1, without departing from the scope of the invention as appears from the enclosed claims.

Figure 1:
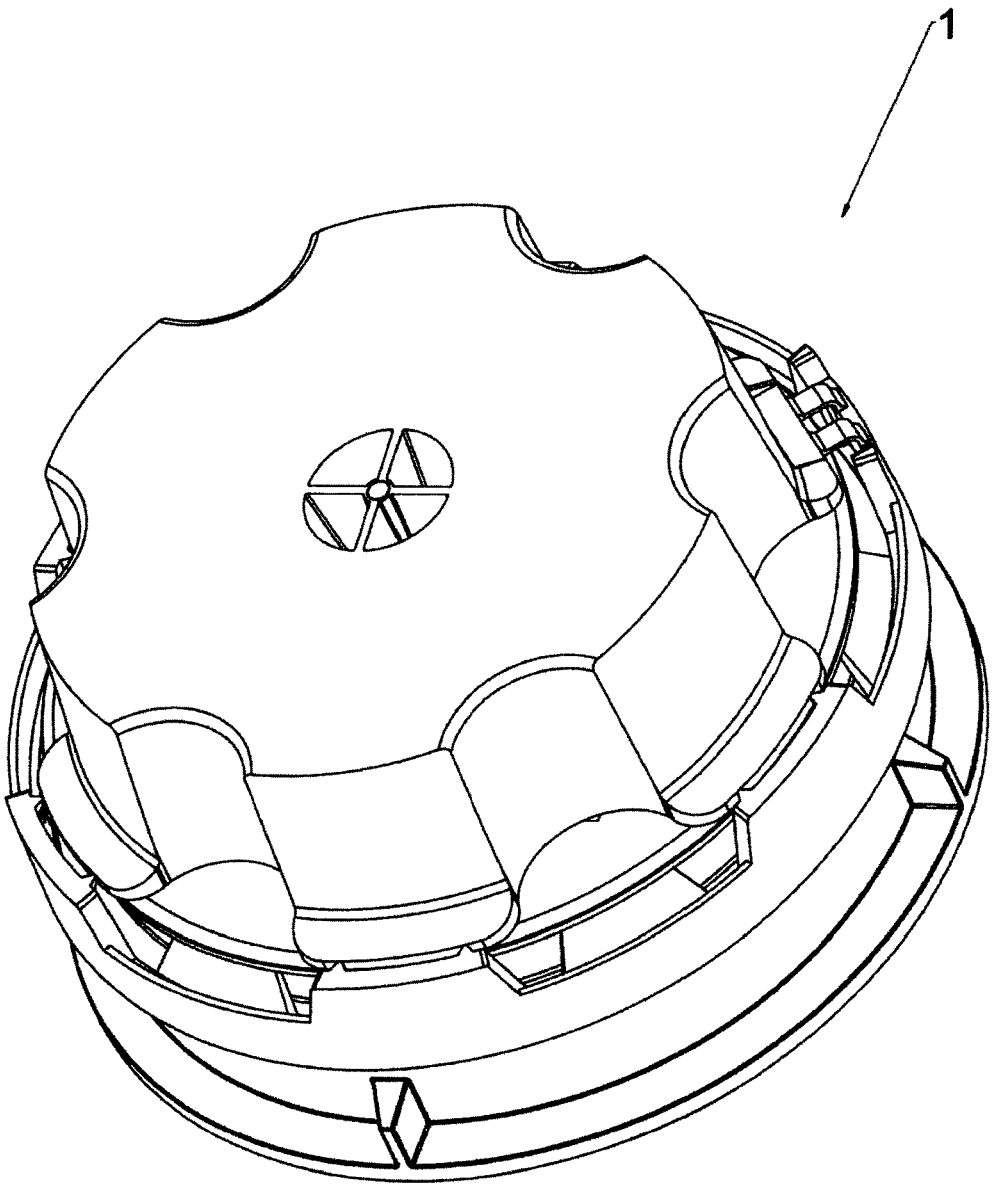
FIG. 1 is a perspective view of an embodiment of the tap according to the present invention.
Figure 2:
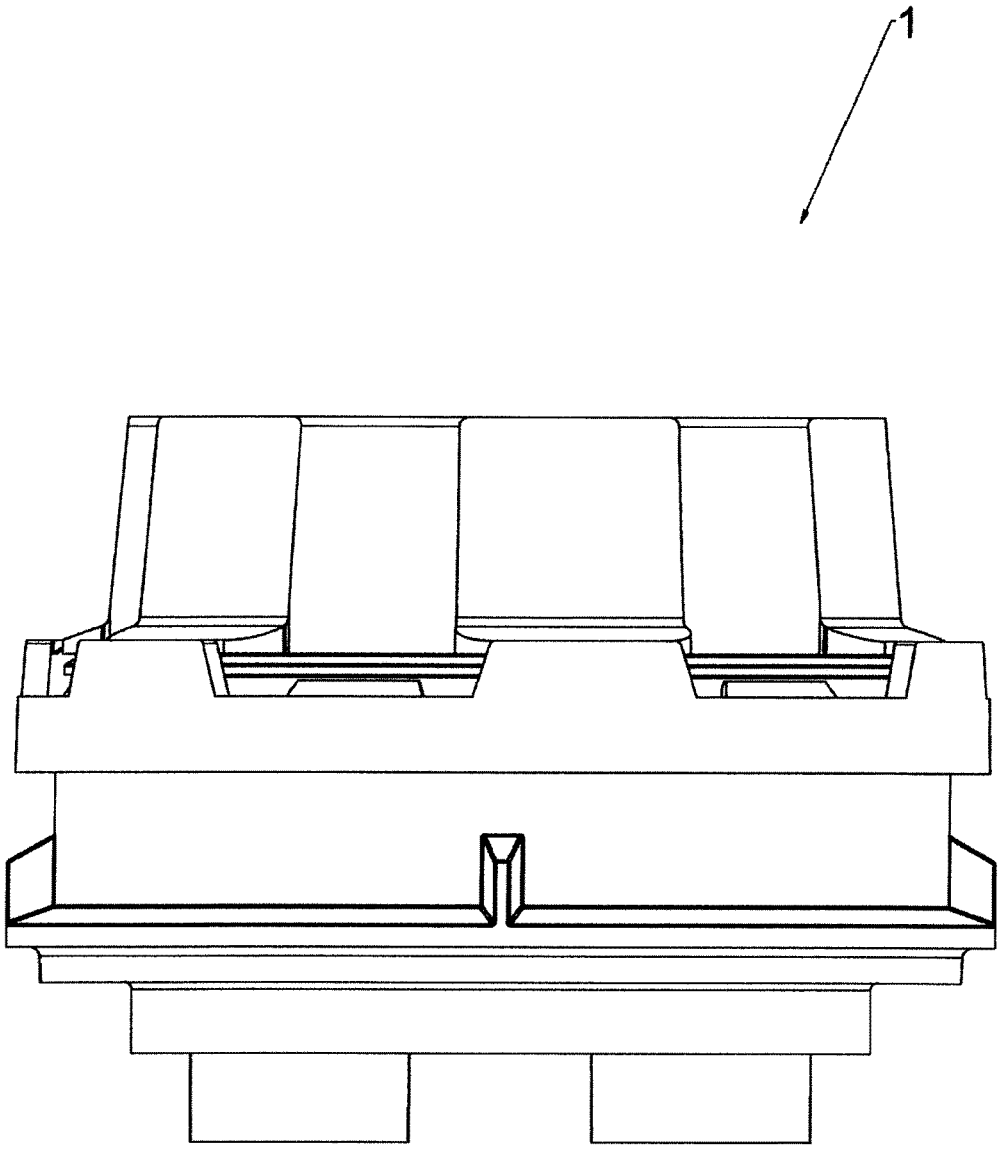
FIG. 2 is a side view of the tap of FIG. 1.
Figure 3:
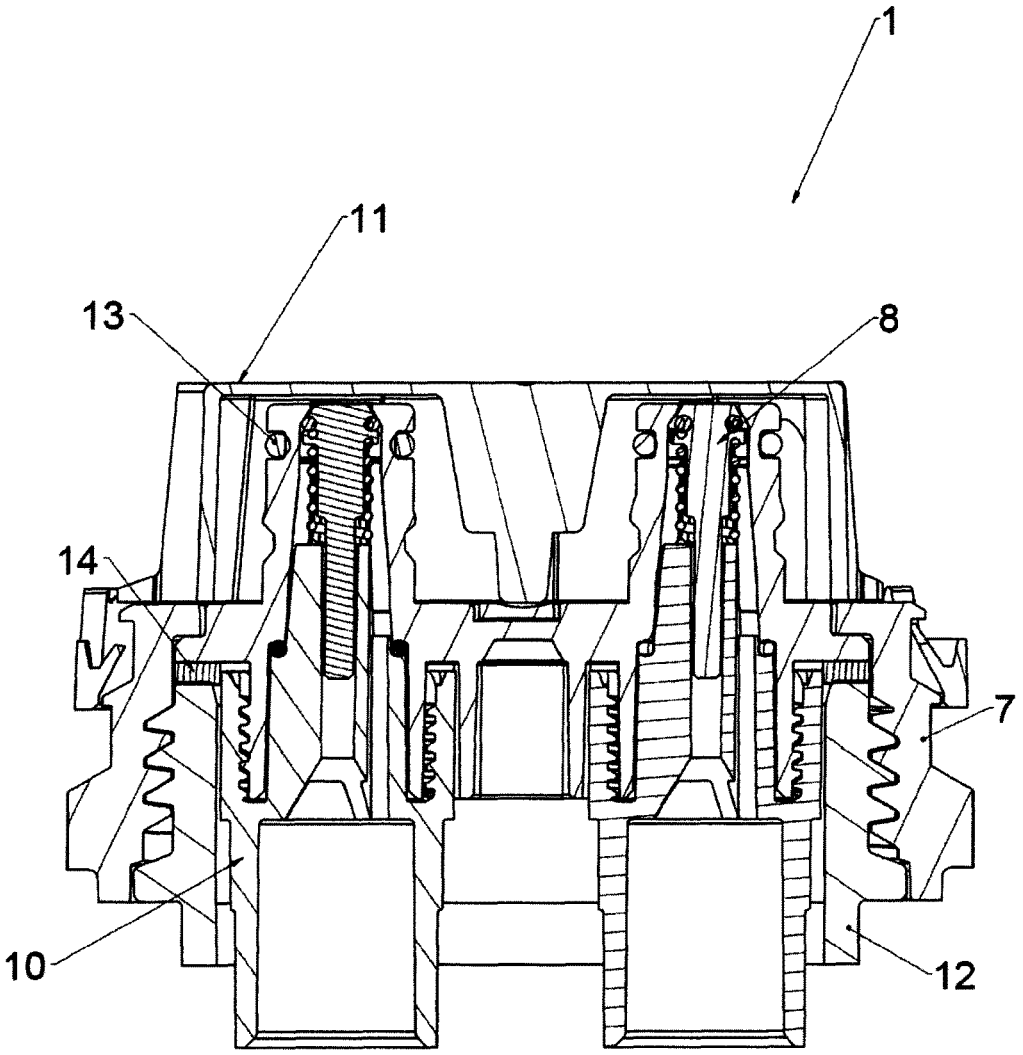
FIG. 3 is a sectional view of the tap of FIGS. 1 and 2.
Figure 4:
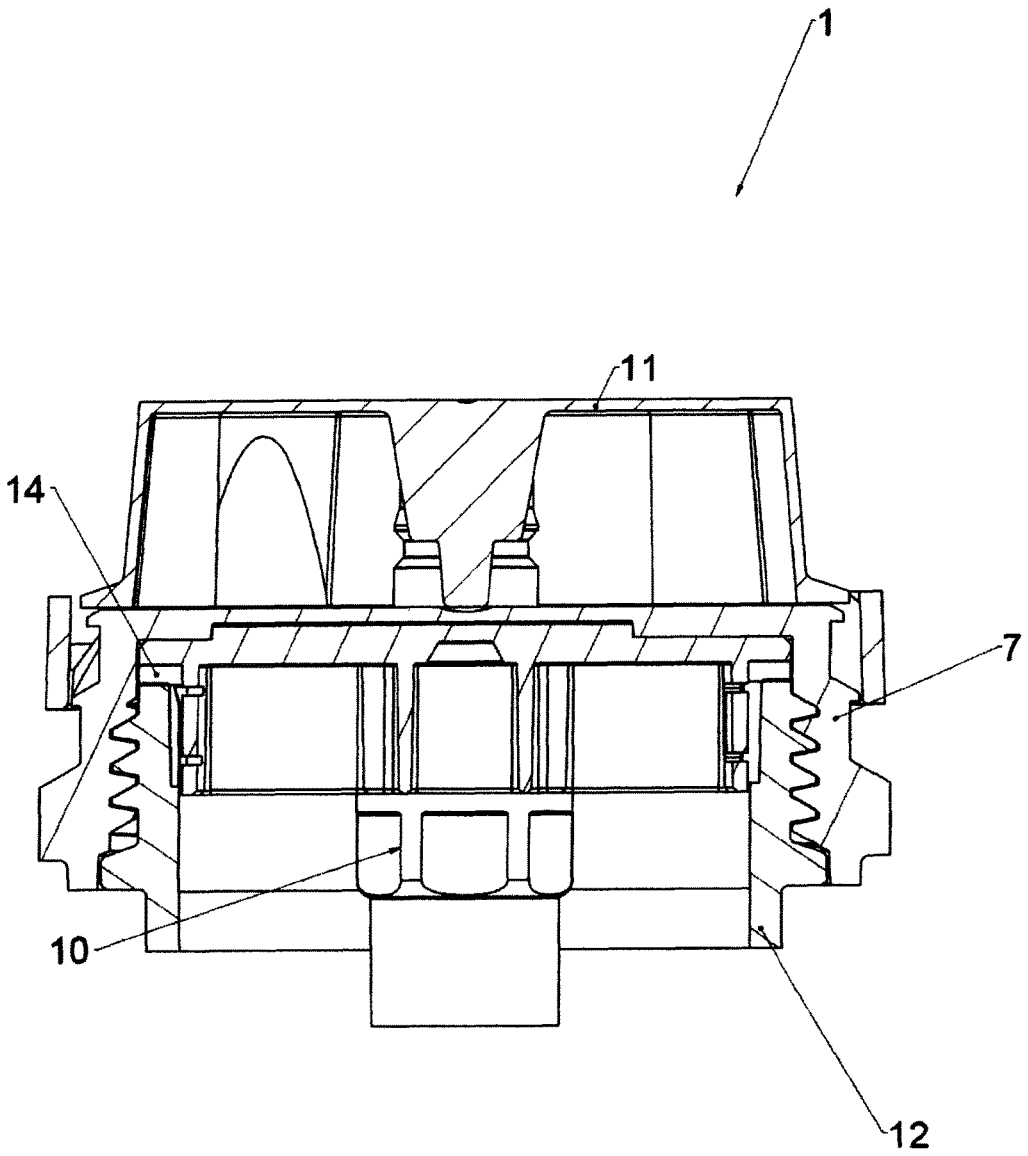
FIG. 4 is a sectional view of the tap of FIGS. 1 and 2.
Figure 5:
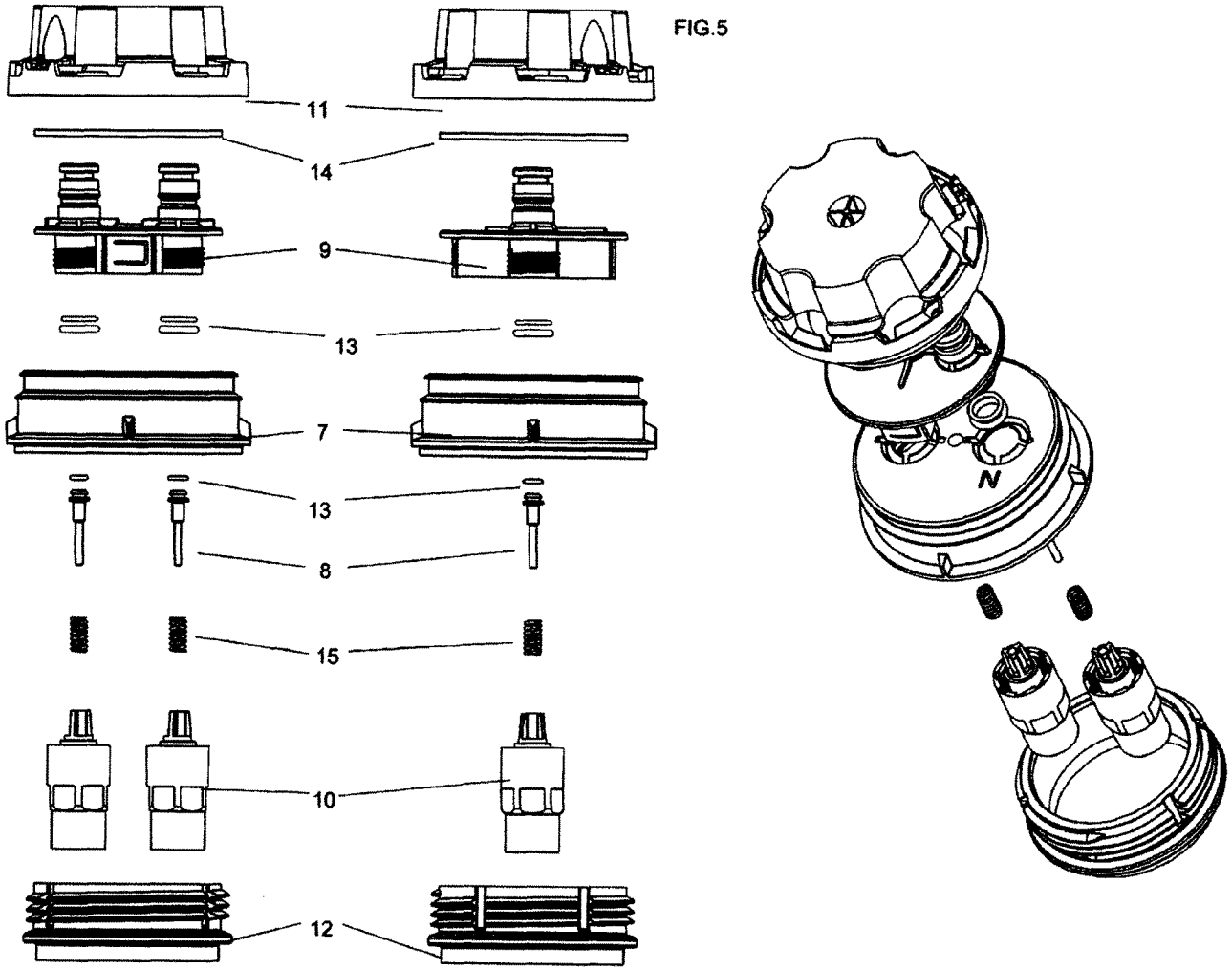
FIG. 5 is an exploded view of the tap of FIG. 1.
Figure 6:
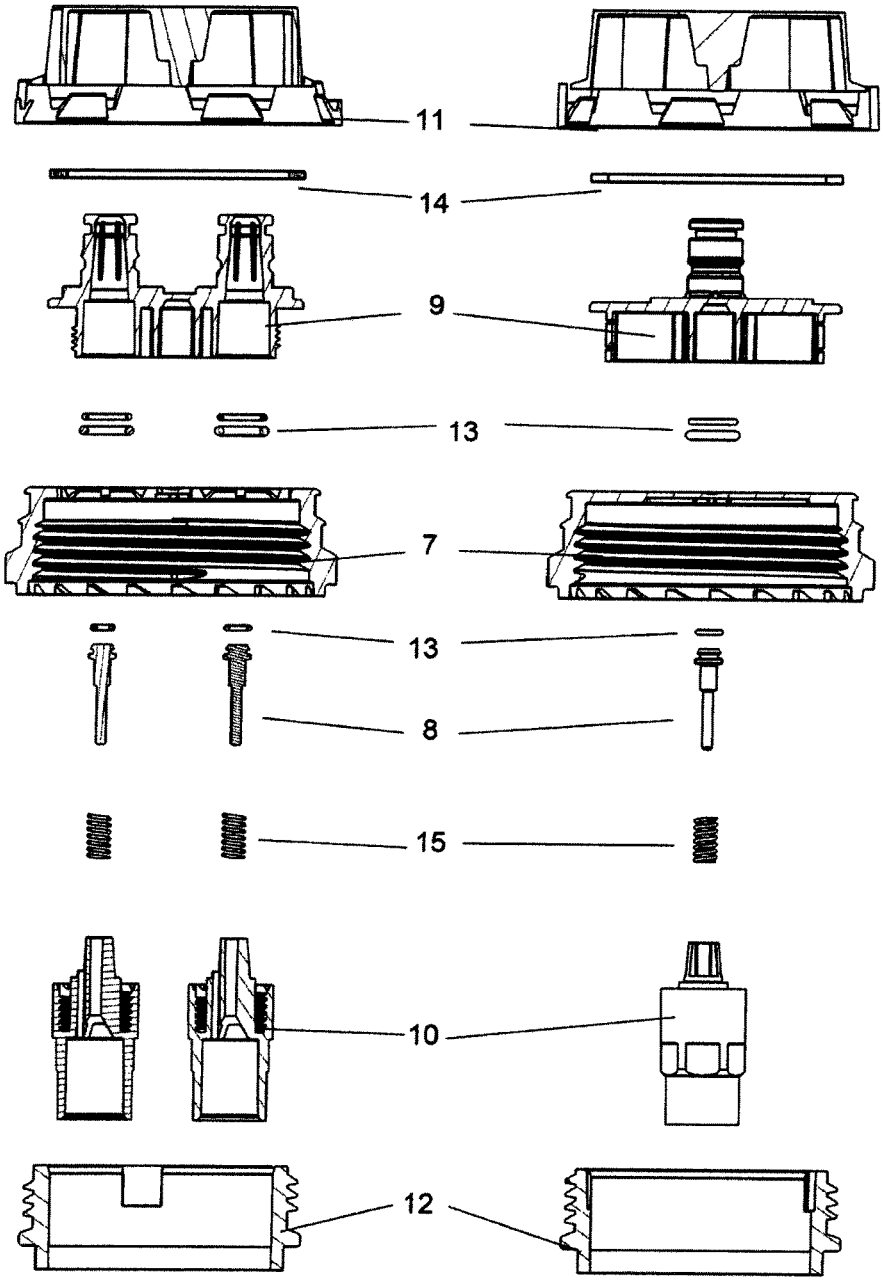
FIG. 6 is an exploded sectional view of the tap of FIG. 1.
Figure 7:
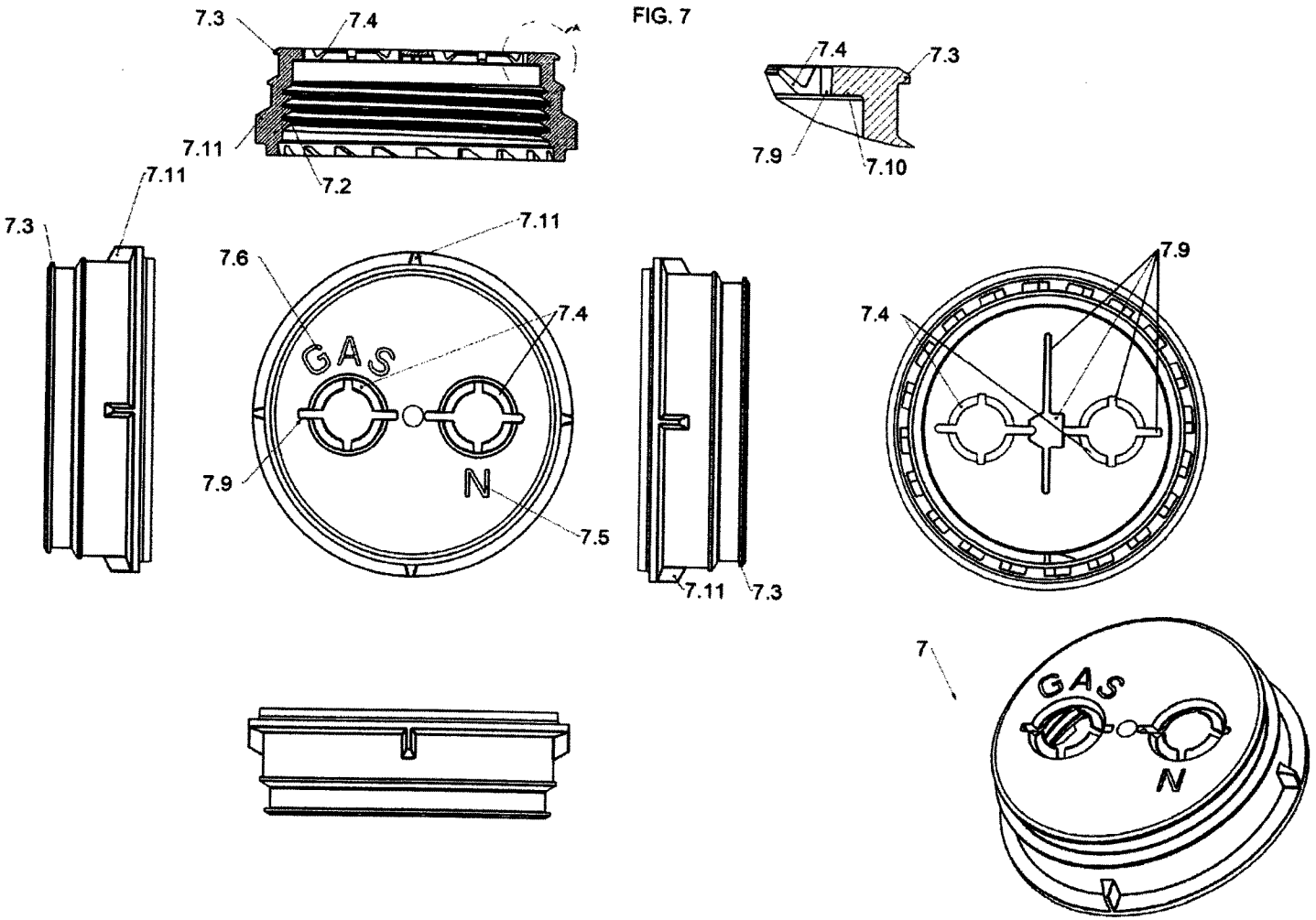
FIG. 7 is a view of the main body of the inventive tap.
Figure 8:
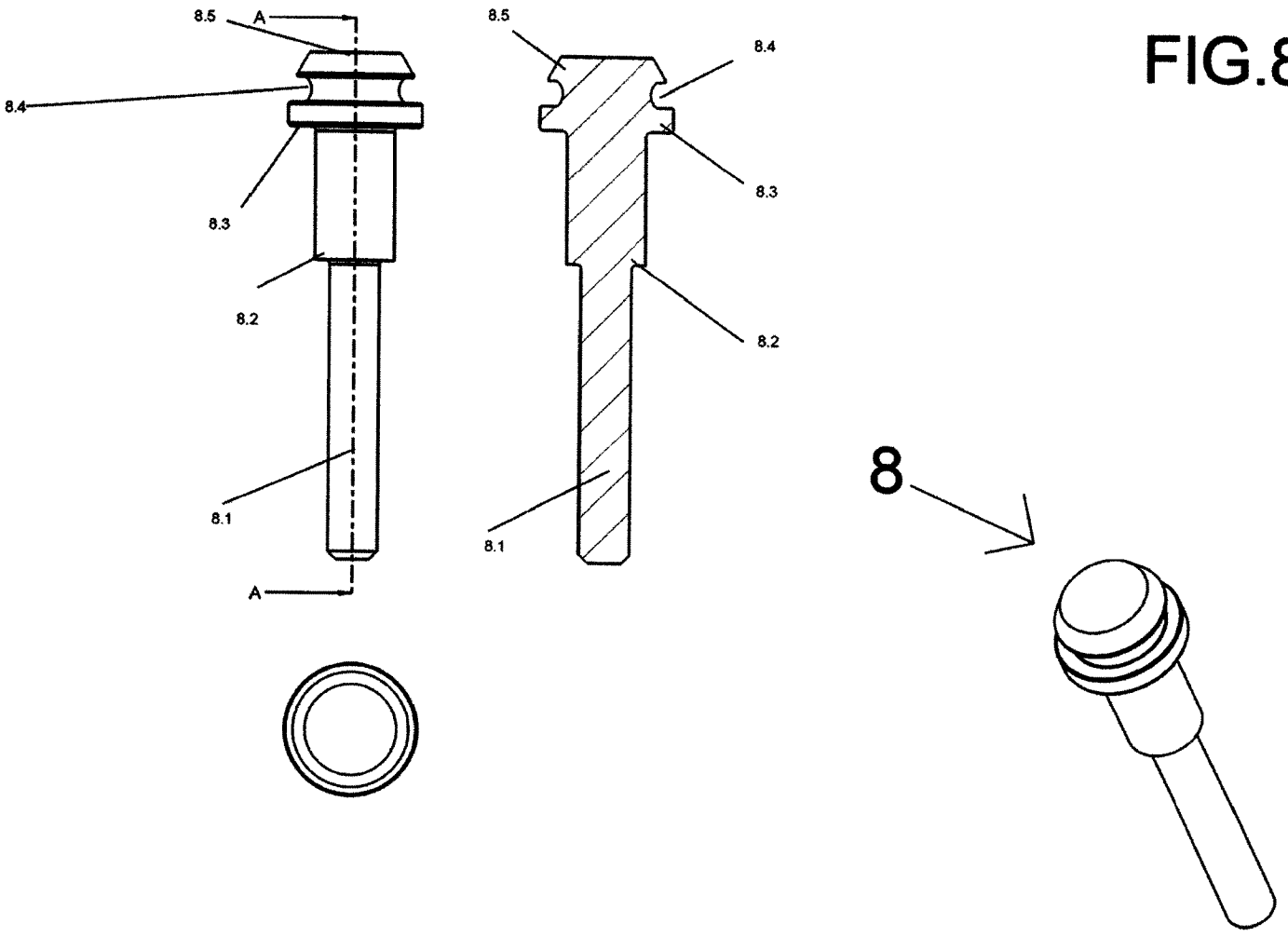
FIG. 8 is a view of the internal piston of the inventive tap.
Figure 9:
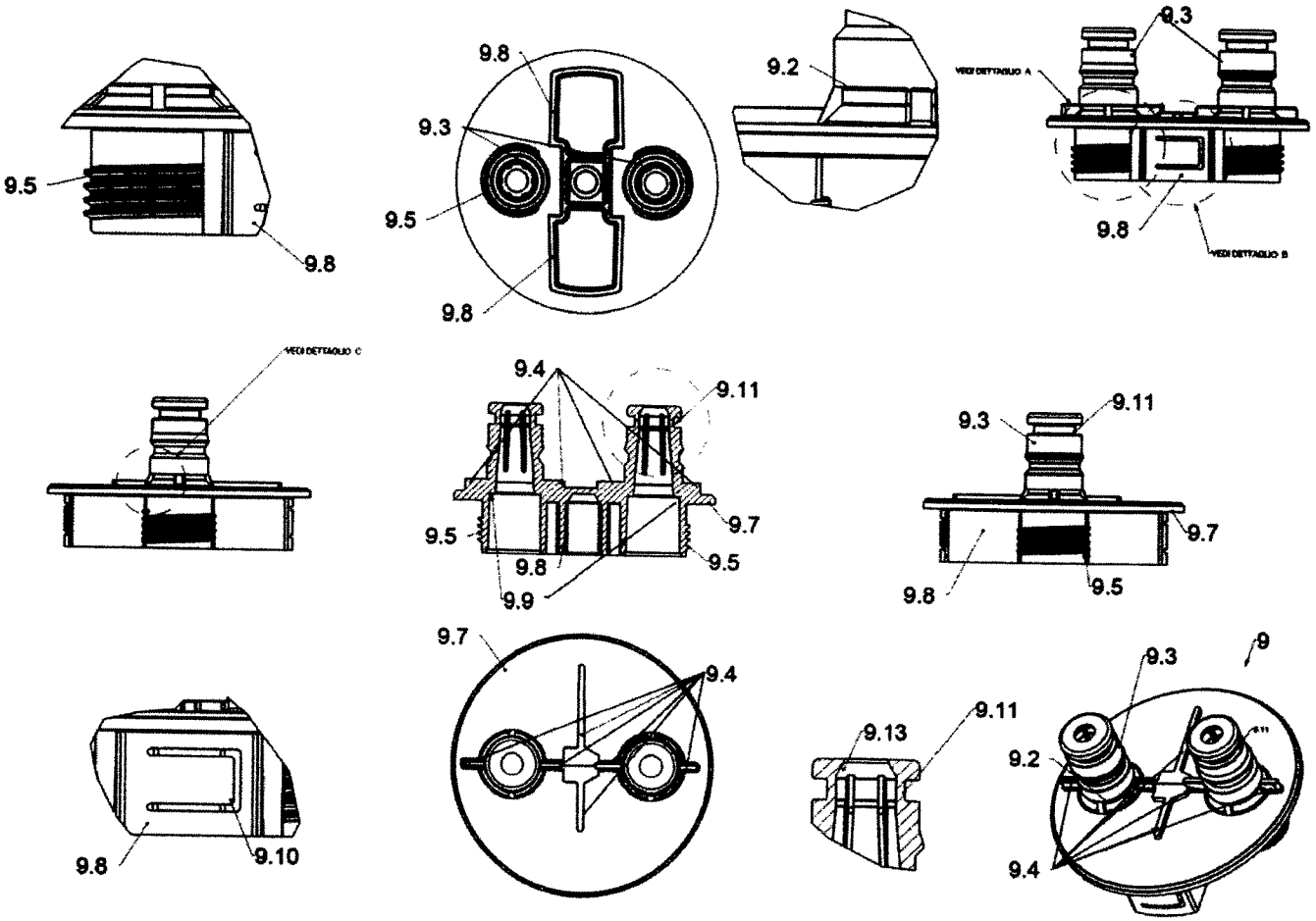
FIG. 9 shows the upper part of the inventive tap with the two turrets.
Figure 10:
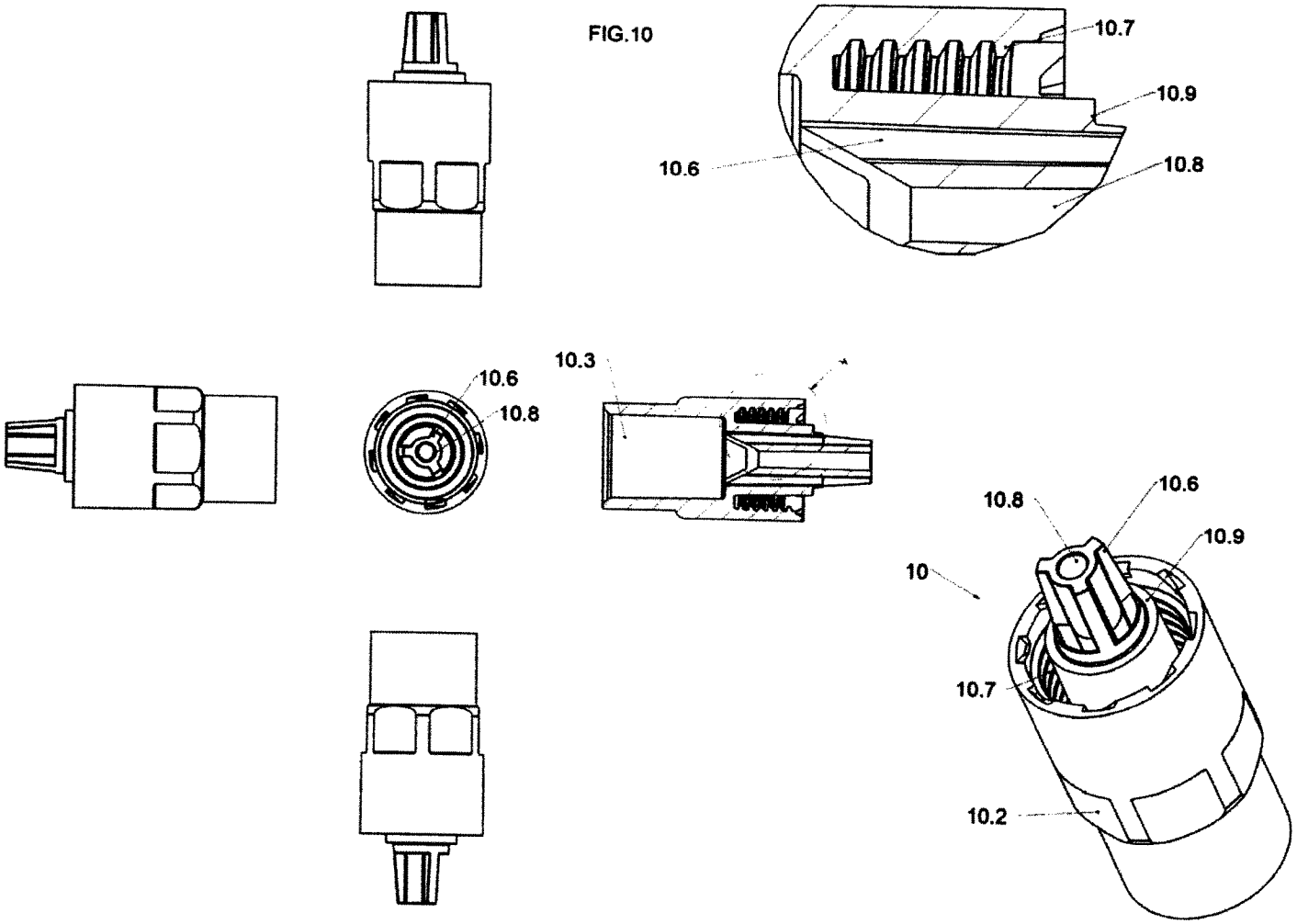
FIG. 10 is a view of one of the two lower parts of the inventive tap.
Figure 11:
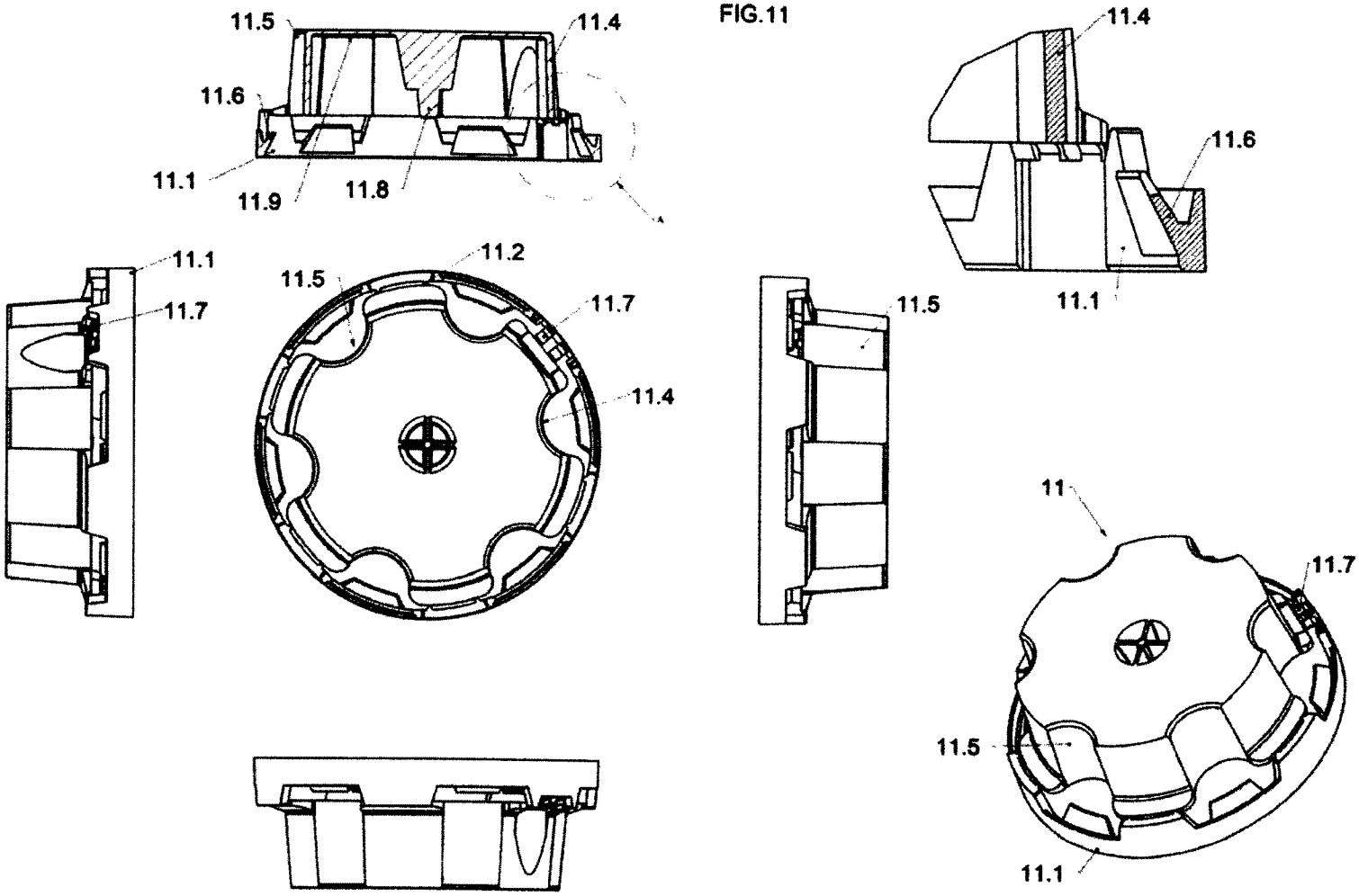
FIG. 11 is a view of the warranty seal for the inventive tap.
Figure 12:
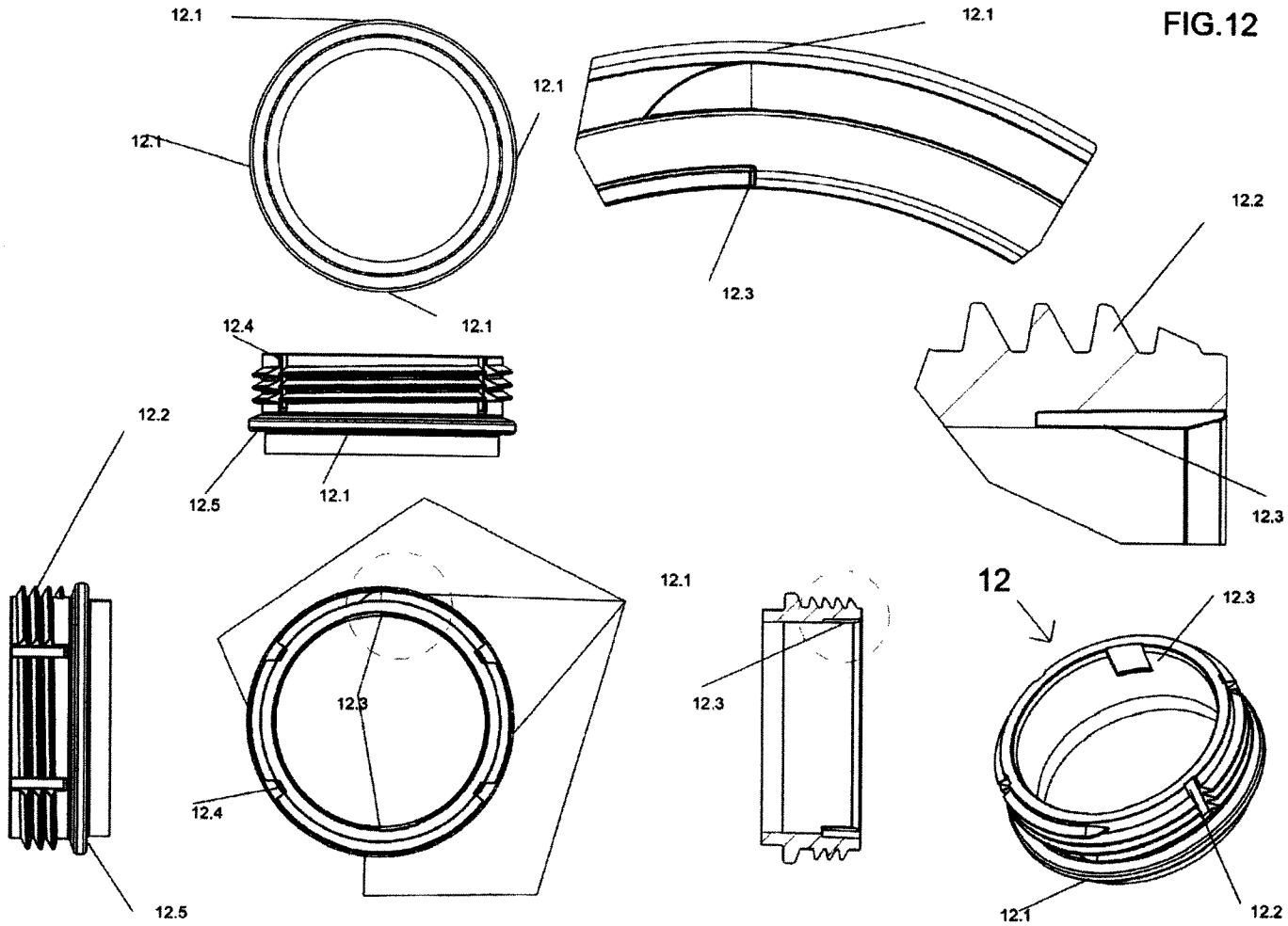
FIG. 12 is the view of the carafe neck to which the inventive tap is applied.
Figure 13:
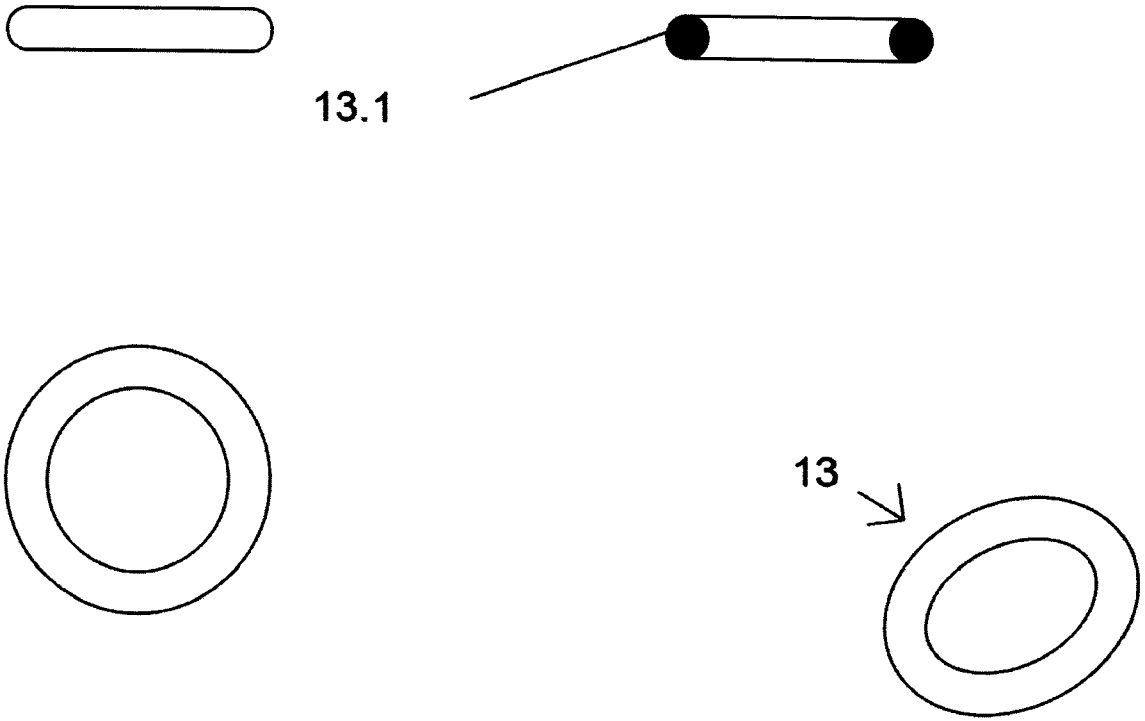
FIG. 13 is the view of the toroidal O-rings assembled on the inventive tap.
Figure 14:
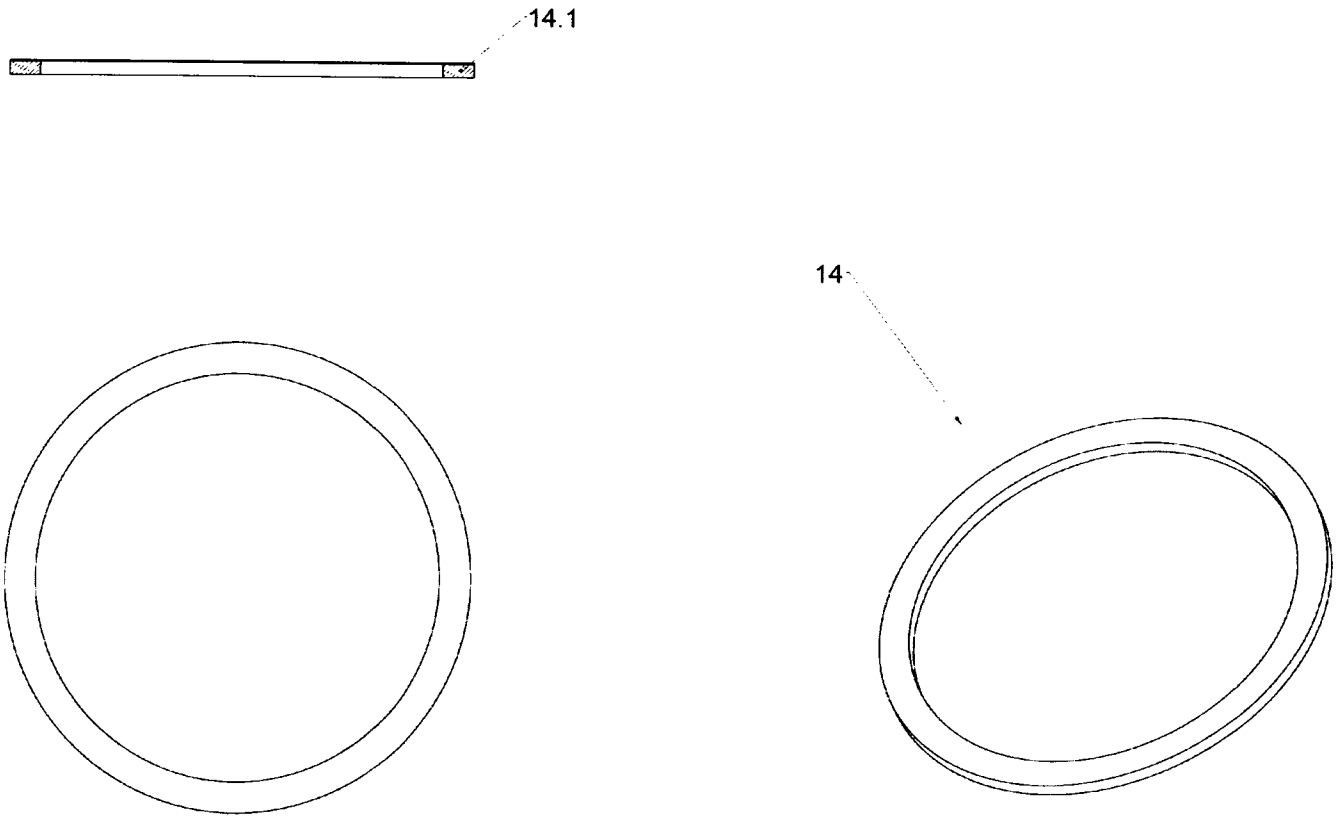
FIG. 14 is the view of the sealing washer with rectangular section between tap and neck keg.
Figure 15:
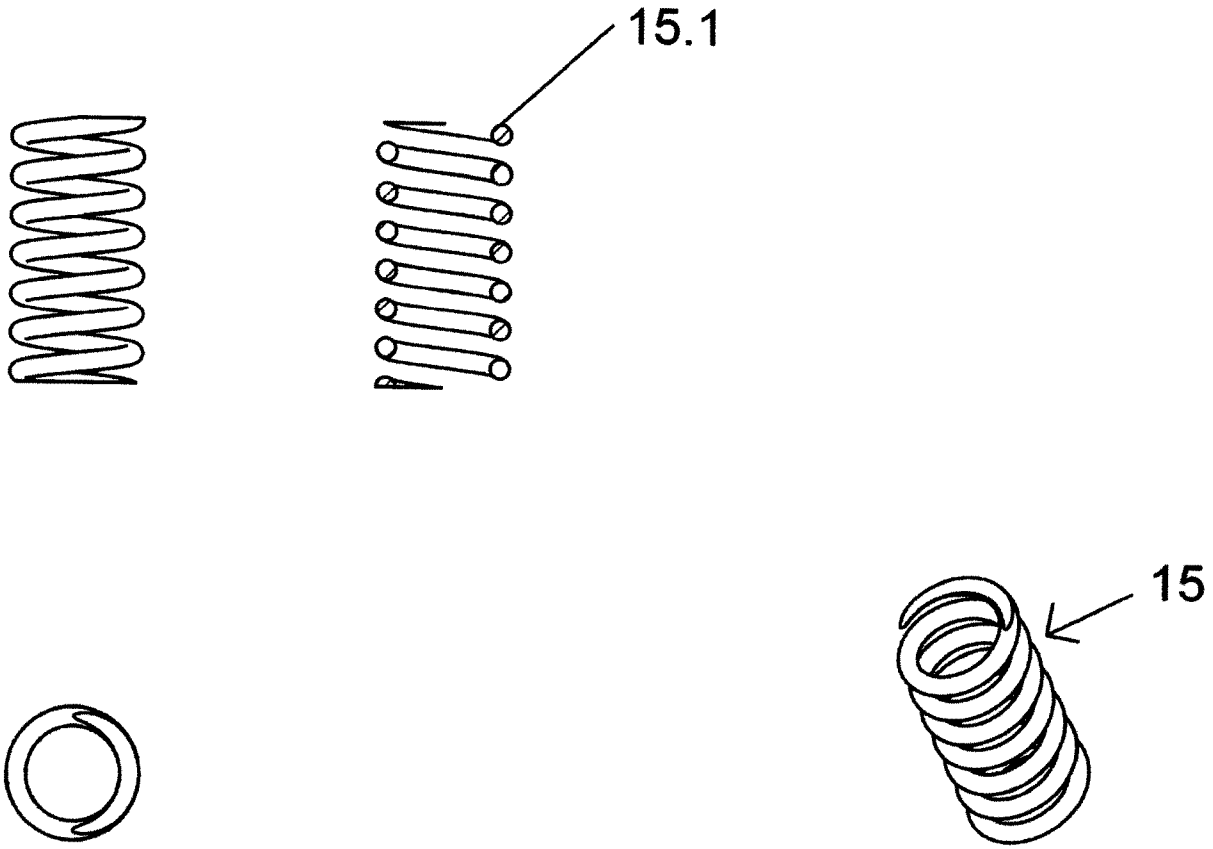
FIG. 15 is the view of internal springs which will be inserted in every connecting turret.
Figure 16:
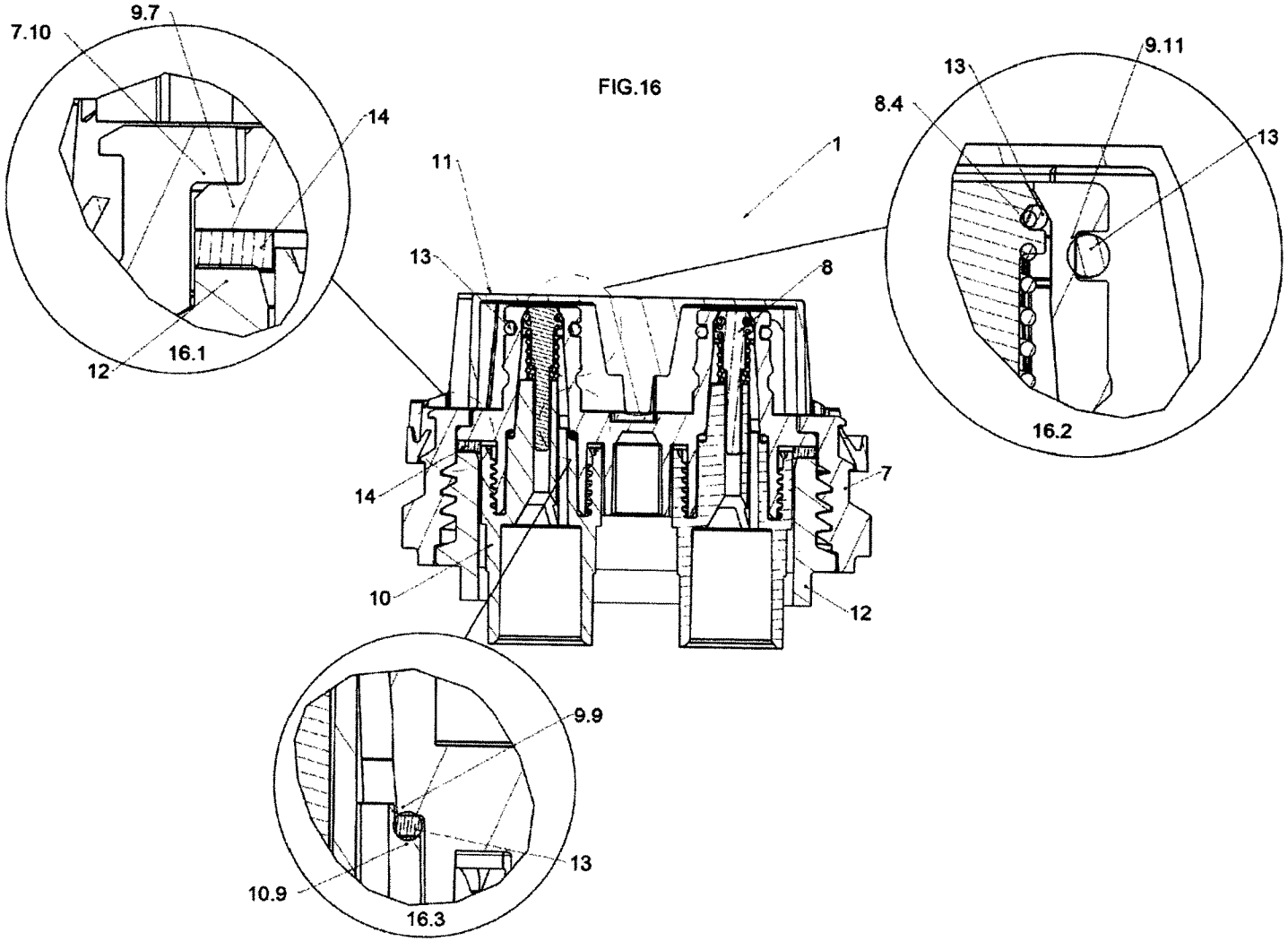
FIG. 16 is the sectional view of the inventive tap with the detail of the operating seals between the various parts which will be described below.

According to the Figures, the improved delivering tap/connector 1 of the invention, in particular for a vessel for liquids of the keg type made of polyethylene terephthalate (PET) (not shown) substantially comprises:

a main body 7.1 (shown in detail in FIG. 7) with an elongated shape, which is used to block the covering device 9.1 (or cover) (shown in detail in FIG. 9 and described below) (and the other components connected to the covering device 9.1 itself) on the neck 12.2 of a carafe of the keg type (FIG. 12) and to provide the right "pull" to the head gasket 14.1 with rectangular section (shown in FIG. 14) in order to have a perfect seal 16.1 (FIG. 16); the body 7.1 has connecting means 7.2 (preferably a fastening threading) to the carafe, adapted to be stably connected with the geometry of the neck 12.2; undercut-type fastening means 7.3 for the warranty seal with degassing key integrated; fastening means, as flexible teeth 7.4, to the covering device 9.1 due to the undercut geometry 9.2, preferably, as stated before, made as flexible teeth; areas dedicated to recognizing the turrets evidencing the words "GAS" 7.6 and 7.5 "N" which, once having assembled the tap 1, considering that the part below the covering device 9.1 could possibly be of a different colour with respect to the body 7.1, will thereby more accurately point out which of the two turrets 9.3 is dedicated to the gas connection ("GAS") 7.6 and which to the liquid connection ("N") 7.5, pointed out, like the word "GAS", directly on the upper side of the part 7.1. There are further a series of "teeth" 7.11, useful to have a catching area necessary for screwing the tap 1 assembled on the neck 12.2; finally, there are transmitting means (of the through-type or not) 7.9 of the circular screwing motion, which transmit the screwing motion to the tap 1 assembled onto the covering device 9.1 due to the geometry 9.4, and consequently to the other components assembled onto the covering device 9.1, the transmitting means comprise a plurality of recesses in an upper surface of the main body for transmitting a screwing motion applied to the tap to the cover;

at least one covering device 9.1 (better shown in FIG. 9), which is composed of a body with two turrets 9.3 (which could be with a geometry for connections both of the pin ball type (shown in the drawing), and of the pin lock type (not shown), and anyway always capable of being customized for every type of "quick" connection or not); the device 9.1 is purposefully divided from the main body 7.1 since, being the main part of the delivering tap/connector, and "pressing" a gasket 14.1 with rectangular section (shown in FIG.14) which in turn will press the neck 12.2 of the carafe due to the body 7.1, generating the main seal of the system 16.1 (FIG. 16), will have to have oxygen permeability features, in addition to consistent mechanical properties, since it will have to bear the internal pressures: therefore, it will be possible to use particular plastic materials for other performances. In this way, it will be possible to produce the main piece with two turrets 9.3 with specific materials; moreover, the uncoupling from the main body 7.1 allows moulding the covering device 9.1 with a different colour, in order to point out the two turrets from the main screwing body 7.1 (once the tap 1 is assembled with the body 7.1); there are also geometries 9.4 between the two turrets 9.3 which will be stably coupled with the hollow geometries (of the through-type and not) 7.9 obtained on the screwing body 7.1, and they will be stably fastened to the body 7.1 transmitting its rotary screwing movement during the assembling/screwing phase of the tap 1 on the keg; the geometry between the two turrets 9.3 has the additional purpose of transmitting the circular screwing motion to the main body 7.1 by means of the geometries 9.4 which will "push" in rotation the covering device 9.1. Undercut-type seats 9.2 will be present at the base of every turret, onto which the fastening teeth 7.4 will be fastened, present on every hole which will house every single turret on the main screwing body 7.1. The lower side of the part with two different turrets 9.1 has two elongated geometries on which two threadings 9.5 are obtained, and on which the two parts 10.1 will be stably screwed. The disk 9.7 is used to transmit the pressure given by the body 7.1 to the covering device 9.1 once screwed, as shown also in 16.1 (FIG. 16). The disk 9.7 is a flange disposed along an outer perimeter of the cover. Moreover, on the part 9.1, between the two threaded cylinders 9.5, there will be an elongated geometry 9.8 on which two flexible wings 9.10 are obtained, which, when screwing, will be adapted to the internal diameter of the neck 12.2 of the carafe and, once having reached the correct position, will "snap" on the two internal geometries 12.3 of the neck 12.2 of the carafe, blocking from inside the possible attempt to counterfeit/remove the closure once it is screwed (where such internal screwing prevention will obviously be requested, which anyway remains an option). The wings 9.10 extend outward into the two recesses disposed along the interior surface of the neck of the vessel, effectively locking the cover and preventing removal of the cover. The fact of possibly having a forgery-preventing geometry inside the system provides more warranty, since it is scarcely reachable by possible forgers; the lower part between the two zones on which there are the threadings 9.5 will be occupied by an elongated body 9.8 which, in addition to having the purpose of "containing" the two geometries 9.10 with flexible teeth for the internal screwing prevention, will also have the purpose of being a stiffening geometry of the body 9, in order to avoid distortions due to the internal pressure; on every turret 9.3 the necessary geometries will be obtained for coupling with the quick connections, and on every turret 9.3 there will be the seats 9.11 of the sealing O-ring 13.1 (pair of insulating sealing O-rings) between tap and quick connection according to the diagram 16.2 shown in FIG. 16; every turret 9.3 will have inside a chute 9.13 onto which the O-ring 13.1 will push, assembled on every piston 8.1, and it will generate an operating seal according to diagram 16.2 shown in FIG. 16; analyzing the internal part of every turret 9.3, the upper seat 9.9 of the O-ring 13.1 can be noted, which will perform, on every turret, an operating seal due to the pressure of the lower seat of the O-ring 13.1 obtained on the part 10.1 in its geometry of lower seat of the O-ring 10.9 as shown in 16.3 (FIG.16);

at least one bottom for every turret 10.1 (shown in detail in FIG. 10), which is composed of a body whose primary function is pre-loading and blocking the springs 8.3 which are below the pistons 8.1 (described below with reference to FIG. 8) of every single delivering turret 9.3; the two turrets 9.3 moreover will guide the pistons 8.1 when opening (and before assembling), also due to the elongated geometry of the piston 8.1 itself; moreover, the ribs 10.6 connected to the guiding cylinder of the stem of the piston 8.1, cooperating with the geometry 8.2 of the piston 8.1, when opening the tap 1, will operate as descent stopper of the piston 8.1, which will then be able to vertically move only by few millimeters, and therefore will be blocked, making the piston 8.1 inside the connections (external to the system and used for connecting the inventive tap 1 to the dispensers), which will be connected to the turrets 9.3, open and allow the flow of gas or liquid, according to the affected connection. In practice, the piston 8.1 of the inventive tap 1 will drop down by a few mm (pushed by a stem which is inside the "external connector" connection) and then will be blocked. At that time, once having blocked the stem of the tap 1, the stem present on the "external connector" connection will be allowed to open, by being in practice pushed by the blocked stem. Thereby, actually, when the external connector will be on the turret 9.3, it will have the ducts (those present on the external connector and those present on the turret 9.3) completely open, allowing the delivery of liquid from existing dispensers. Moreover, the geometries 10.3 will allow the connection of the dip tube, which will be put under the turret-type connection where liquid passes; below the rib-type geometries 10.6 present on every turret 9.3, there is an area which operates as seat 10.9 for a sealing O-ring 13.1 (shown in FIG. 13), which will seal the geometry 9.9 which operates as "counter-seat" of the O-ring 13.1 of the covering device 9.1, and in this, by sealing on every single turret, will generate separate ducts (one for air/gas and one for liquid) as shown in 16.3 (FIG. 16). On the central part of the ribs, a tapered duct 10.8 will be obtained, for sliding the sealing piston 8.1 (shown in FIG. 8) guaranteeing its perfect sliding along a vertical axis during the opening and closing step. There is also a threaded area 10.7 useful for a connection with the geometries 9.5 (shown in FIG. 9); a bolt-type" geometry 10.2 (preferably an hexagonal bolt) will be present externally, useful for assembling the piece to have a "grip" area for screwing the bottom 10 onto the body 9. Obviously, by modifying the parts 9.5 (of the body 9) and 10.7 (of the bottom 10), variations of the connecting system can be made (for example engagement systems if, in place of the threading 9.5, there will be an undercut-type tooth and, consequently, in place of the threading 10.7, there will be a slit useful for a stable engagement of the two parts) which will anyway fall within the scope of the present invention, though not shown;

at least one piston 8.1 (shown in detail in FIG. 8), which is the element with an elongated shape on which the sealing O-rings 8.4 (first and second sealing O-rings) will be placed, which, due to the thrust of the spring 8.3 below, will generate the airtight closing and/or the opening of the turrets 9.3, as shown in 16.2 (FIG. 16). The piston 8.1 has a seat for the sealing O-ring 8.4 with chamfered head, which will be adapted to the internal profile of the turrets 9.3, an upper abutment zone of the metallic spring 8.3 (the lower abutment zone 10.6 is on the threaded bottom of every single turret 10.1); there will also be a mechanical stopper geometry 8.2, which limits the excursion of the piston 8.1 to few mm when opening, by abutting against the geometry 10.6 of the bottom 10.1. Moreover, there is a vertical, cross-type guide;

at least one seal 11.1 (better shown in FIG. 11): it is a body adapted to protect the turrets 9.3 of the covering device 9.1 after filling, and adapted to possibly support the weight of the parts being stacked on a pallet; this is a protecting, hygienic and above all forgery-preventing device, which allows determining the packaging integrity by means of a tamper-evident, ring-type system 11.1 and of breakable jumpers 11.2; moreover, there is a cover constrained by a hinge 11.7, capable of being fractured, namely, after the first opening, the cover will be constrained to the tamper-evident ring to avoid losing it, but then, when the keg has been used, it will be possible to "break" this hinge and use the cover for its second and major inventive scope, namely as degassing key, using the internal geometry 11.8. The tap, as stated, will be removable, connected to a hinge-type geometry 11.7 which prevents its cover from being lost once opened, but remains constrained to the inventive tap 1 till the user decides to remove it by tearing the hinge itself. There are further the geometries 11.4 with circular section, which increase the structural resistance of the part; finally, there are catching areas 11.5 (a plurality of recesses 11.5 in an exterior surface of the main body for providing grip to screw the tap onto the neck of the vessel) to facilitate the catch for removing the seal; moreover, there is a central pin integrated in the piece 11.8 itself, which will integrate in the warranty seal also a tool, which is generally a very costly piece apart, which will be used to degas the keg once having ended its life cycle, and will thereby allow recycling its various components. In fact, by removing the gas, and therefore the pressure, inside the keg, it will be possible to disassemble the various components of the keg and throw them into the suitable drums for their best recycling. The seal with degassing key is used by pushing the central pin of the seal 11.8 on one of the two turrets, pushing towards opening the pin 8 contained therein and which performs an operating seal (preferably the one designated with "GAS") in order to discharge the pressure at the end of its use. The tamper-evident cup 11.9 in this case is also working as protection for the eyes, since gas discharged from the turret meets the internal walls of the cover, which prevent gas itself from discharging on the user face. Finally, the tap 1 is engaged with a system with flexible wings 11.6 on the geometries 7.3 obtained on the body 7.1;

at least one neck 12.2 of a carafe (shown in detail in FIG. 12): this is the bottle neck 12.2 with particular geometries which is preferably associated with the inventive tap 1; it is an elongated body 12.2 equipped with thread with safety device 12.4 for discharging gas if a forced and accidental opening occurs, which allows, in case of forced unscrewing, discharging the pressure inside the vessel before the whole unscrewing is completed, and therefore the tap 1 is "free" of moving and possibly injuring the user who is unscrewing it; it is further equipped with: an external ring 12.5 possibly adapted to support a handle (not shown); external blocking or forgery-preventing means 12.1; internal forgery-preventing means 12.3, which will operate, once having screwed the tap 1 on the neck 12.2, with the flexible wings 9.5 of the covering device 9.1. The internal forgery preventing means 12.3 comprises two internal recesses disposed along an interior surface of the neck, and the external forgery-preventing means 12.1 comprises a flange on an external surface of the neck.

With the above described arrangement, according to the invention, a tap 1 is obtained, for beverages vessels preferably made of polyethylene terephthalate (PET), which is recyclable and disposable, has two connections (turrets) and is specific for carbonated beverages, and with dedicated and specific connections for the manufacturers of beverages currently on the market.

The tap 1 of the invention has a low cost, two separate, preferably parallel ways (one for gas and one for liquid) (two turrets) and with specific geometries which can be adapted to the two systems on the market (pin ball and pin lock), which allow a connection to existing systems for dispensing beer, wine and in general all carbonated, draft beverages.

The solution associated with new unidirectional plastic vessels, preferably made of PET, offers environmental and economic benefits.

The tap 1 of the invention provides economic and ecologic advantages with respect to existing systems on metal kegs and to other plastic variations currently on the market (less pieces which are easier to assemble and less costly, being made of plastic and obtained from injection moulding).

The tap 1 of the invention, associated with plastic vessels, preferably made of PET, provides major advantages for beer and wine shops and all distributors of carbonated beverages and other users of kegs—above all when compared with metal kegs.

They are: lower total property costs, reduction of environmental impacts, new market opportunities and quicker response to variations of the short-term demand.

The passage from metal kegs to plastic kegs, preferably made of PET, equipped with the inventive tap 1, allows saving in terms of capital and operating costs.

These are potentially important savings in terms of used capital, removing the need of keeping a wide series of kegs. Removing the excessive number of kegs allows freeing important sums invested in such "assets" and does without the need of further constant expenses for replacing damaged, lost or stolen kegs.

Moreover, it is not necessary to use costly tracing systems.

Further savings are possible regarding further savings in terms of capital with the removal of costly and complex cleaning systems for kegs.

The use of spaces is more efficiently improved, as consequence of the elimination of the need of storing a high number of kegs when the demand is low, to have them available during demand peaks.

By removing the return of used metal kegs, cleaning and re-use costs are reduced. With the plastic keg, preferably made of PET, not only the vessel but also the valve and the taps 1 are disposable total absence of return and cleaning costs.

Strong savings in terms of logistics are also guaranteed, not only by removing the return costs in case of metal kegs, but also reducing the delivery costs outside for filled kegs. Kegs made of PET are lighter than metal kegs containing the same volume of liquid. Consequently, a higher number of kegs can be loaded on every vehicle going out of the factory.

The main components of the taps 1 are wholly recyclable with dry wastes or following the normal plastic recovering cycle, as provided for single manufacturing systems and plants.

The tap 1 of the invention is designed to allow the owners of bars and restaurants to use the kegs exactly in the same way of the metal kegs.

Without proceeding to any replacement of fixtures available in bars or canteens, they will immediately be able to benefit from the advantages of the plastic keg on which the tap 1 of the invention will be placed; reduced weight, easy storage and recyclability.

The availability of a two-way tap 1 produced under hygienic conditions means that the keg users will have less to worry about health and safety, and less work to keep the taps 1 and equipment clean. All components of the keg and of the taps 1 will be approved for foodstuff use.

Other features of the inventive tap 1 are:

since the covering device 9.1 is uncoupled from the main body 7.1, there is the chance of moulding with highly technical materials only the major part of the tap 1, and not the whole piece, actually doing away with the waste of technical material for geometries for which certain features are not useful, and therefore actually saving the use of these highly costly materials, for example increasing the oxygen barrier;

at the end of filling the keg with a liquid, it will be possible to place a tamper-evident element or warranty seal, which will protect it hygienically and will help locating the kegs which have already been used (forgery prevention);

moreover, the warranty seal will have such a geometry as to allow stacking the barrels;

another important innovation is that the warranty seal has integrated geometries 11.8, which will allow the part to also operate as degassing key, thereby avoiding to have a very costly dedicated and additional tool;

the tap 1, as previously stated, will be unidirectional like the associated vessel, and this will allow having strong advantages at economic and ecologic level. The tap 1 for such purpose will be composed of the various components made of recyclable plastic (only the two internal springs will be made of stainless steel);

the system will allow moulding the main piece (the one with the two turrets) in PET (for example), thereby with an analogue product to the vessel on which it will be assembled. There will be above all the chance of moulding the piece with the two parallel turrets in a material with high oxygen barrier;

the tap 1 of the invention will have forgery-preventing systems which are internal (two sealing areas) and possibly external (four sealing areas not shown in these drawings) to the product, in order to protect integrity and quality of the internal beverage (this feature is not guaranteed in current kegs, because they have no forgery-preventing geometries of this type). In this way, it is guaranteed that the keg cannot be re-filled again (after its first use), unless the tap 1 is destroyed, but then it will be very easy for a user to locate the forged kegs.

The assembly of the inventive tap 1 on the plastic vessel (preferably PET) occurs as follows:

1) the tap 1 will be supplied to the distributing company divided from seal/degassing key, which will then be placed as guarantee of the product integrity and originality, after having filled the plastic keg barrel;

2) the tap 1 will be placed for its screwing (or a snap, solution non shown, but which, being wholly equivalent to the above described one, falls within the scope of the present invention) before filling on the vessel, also as warranty of internal hygiene;

3) when screwing, the different types of external forgery-prevention (not shown) will be "activated", together with the internal flexible teeth 9.10 present on the covering device 9.1 and on the main body 7.1 (not shown in this version), due to the elements 12.1 and 12.3 present on the carafe neck 12.2;

4) once screwed, unless the tap 1 is destroyed, the closure will remain fastened to the carafe neck 12.2;

5) the filling step will then start, and then the warranty seal with integrated degassing key 11.8 will be positioned.

The invention claimed is:

1. A delivering tap made of plastic for a vessel for liquids, the vessel having a neck, the delivering tap comprising:

a) main body adapted to connect to the neck of the vessel, the main body having a first end;

b) at least one cover coupled to the first end of the main body, the cover having a first turret for gas entering the vessel and a second turret for liquid exiting the vessel, each turret comprising a turret body and a turret bottom, each turret bottom operatively threadedly coupled to a respective turret body, said each turret bottom having a tapered duct;

c) a first piston located inside the first turret and a second piston located inside the second turret, the first piston operatively coupled to the first turret by a first sealing O-ring and the second piston operatively coupled to the second turret by a second sealing O-ring, wherein each piston is configured to the first and the second O-rings to control an opening of one of the turrets simultaneously with a closing of the other turret;

d) a pair of insulating sealing O-rings for said each turret bottom for separating passage of gas from passage of liquid;

e) a spring disposed in said each turret bottom to push the corresponding piston against an inside surface of the corresponding turret, such that the pistons are biased to a closed position for preventing flow through the corresponding turret, said each piston having a stem that slides within the tapered duct of the corresponding turret bottom;

f) at least one tamper seal to indicate external access to the turrets placed above and around the cover; and g) at least one degassing key integrated into the seal for degassing the vessel.

2. The delivering tap of claim 1, wherein the tap is made from polyethylene terephthalate.

3. A combination comprising:

a) a plastic vessel for holding liquids, the vessel comprising a neck;

b) a delivering tap comprising:

i) a main body connected to the neck of the vessel, the main body having a first end;

ii) a cover coupled to the first end of the main body, the cover having a first turret for gas entering the vessel and a second turret for liquid exiting the vessel, each turret comprising a turret body and a turret bottom, each turret bottom operatively threadedly coupled to a respective turret body, said each turret bottom having a tapered duct and a seat;

iii) a first piston located inside the first turret and a second piston located inside the second turret, the first piston operatively coupled to the first turret and the second piston operatively coupled to the second turret to control an opening of one of the turrets simultaneously with a closing of the other turret;

iv) a pair of insulating sealing O-rings for said each turret bottom for separating passage of gas from passage of liquid;

v) a spring is disposed in said each turret bottom to push the corresponding piston against an inside surface of the corresponding turret, such that the pistons are biased to a closed position for preventing flow through the corresponding turret, said each piston having a stem that slides within the tapered duct of the corresponding turret bottom;

vi) at least one tamper seal to indicate external access to the turrets placed above and around the cover; and vii) at least one degassing key integrated into the seal for degassing the vessel; and wherein the neck of the vessel is equipped with internal and external neck forgery-preventing means, wherein both the internal and external neck forgery-preventing means adapted to cooperate with the at least one tamper seal of the tap, the internal neck forgery preventing means comprising two internal recesses disposed along an interior surface of the neck, and the external neck forgery-preventing means comprises a flange on an external surface of the neck.

4. The vessel of claim 3, wherein the main body is adapted to block the cover on the neck to provide a seal, the main body operatively threadedly coupled to the neck of the vessel, the main body comprising:

a) fastening means comprising an external lip for fastening the main body to the tamper seal;

b) fastening means comprising flexible teeth for fastening the vain body to the cover; and c) main body forgery-preventing means that fasten onto elements present on the neck of the vessel.

5. The vessel of claim 4, wherein the main body further comprises an indicator, the indicator comprising the word "GAS", and the letter "N", to indicate which of the turrets is for a gas connection, and which of the turrets is for a liquid connection.

6. The vessel of claim 4 wherein the main body further comprises:

a) a plurality of recesses in a peripheral exterior surface of the main body for providing grip to screw the tap onto the neck of the vessel; and b) transmitting means comprising a plurality of recesses in an upper surface of the main body for transmitting a screwing motion applied to the tap to the cover.

7. The vessel of claim 3, wherein the cover applies a head gasket onto the neck of the vessel, the cover comprising:

a) a plurality of fastening teeth fastening the cover to the main body of the tap;

b) a seal to keep the third O-ring in place;

c) a flange disposed along an outer perimeter of the cover to transmit pressure applied to the body to the cover;

d) a plurality of connecting slits or holes coupled with securing means obtained on the bottom; and e) at least two flexible wings that conform to an internal diameter of the neck of the vessel and, after reaching a final position, the wings extend outward into the two recesses disposed along the interior surface of the neck of the vessel, effectively locking the cover and preventing removal of the cover.

8. The vessel of claim 3, wherein the turret bottoms secure the springs contained therein, the springs being below the pistons, said each turret bottom comprising:

a) a guiding cylinder for guiding the corresponding piston;

b) a plurality of ribs connected to the guiding cylinder, the ribs operating as a stopper to stop descent of the piston, locking the piston in the open position to allow the flow of gas or liquid; and c) a sealed engagement area below the ribs to seal with the cover and create separate ducts for air and for liquid.

9. The vessel of claim 8, wherein the seats of the turret bottoms are each configured to connect to a dip tube.

10. The vessel of claim 8 wherein the turret bottoms are threaded onto the cover.

11. The vessel of claim 3, wherein each of the first and second pistons is an elongated element and has:

a) a seat onto which the corresponding either the first or second sealing O-ring is disposed;

b) a chamfered head which conforms to the inside surface of the turrets;

c) an upper abutment area that abuts the spring;

d) a lower edge to limit a movement of the piston when opening by abutting against the turret bottom; and e) a vertically extending guide having a cross-shape.

12. The vessel of claim 3, wherein the tamper seal protects the turrets after a filling, the tamper seal comprising a tamper-evident system, breakable jumpers, and a removable cover.

13. The vessel of claim 3, wherein the neck is an elongated body equipped with a threaded safety device for discharging gas in case of forced and accidental opening.

14. The vessel of claim 13, wherein the neck comprises an external ring to support a handle.

15. The vessel of claim 3, wherein the vessel is made from polyethylene terephthalate.

16. The vessel of claim 7, wherein the plurality of fastening teeth of the cover are flexible.

17. A delivering tap for a vessel for liquids, the vessel having a neck, the delivering tap comprising:

a) a main body adapted to connect to the neck of the vessel, the main body having a first end;

b) at least one cover coupled to the first end of the main body, the cover having a first turret for gas entering the vessel and a second turret for liquid exiting vessel, each turret comprising a turret body and a turret bottom, each turret bottom have a tapered duct disposed therein;

c) a first piston located inside the first turret and a second piston located inside the second turret, the first piston operatively coupled to the first turret by a first sealing O-ring and the second piston operatively coupled to the second turret by a second sealing O-ring;

d) a pair of insulating sealing O-rings for said each turret bottom for separating passage of the gas from passage of the liquid;

e) a spring disposed in said each turret bottom to push the corresponding piston against an inside surface of the corresponding turret, such that the pistons are biased to a closed position for preventing flow through the corresponding turret, each piston having a stern that slides within the tapered duct of the corresponding turret bottom;

f) at least one tamper seal to indicate external access to the turrets placed above and around the cover; and g) at least one degassing key integrated into the seal for degassing the vessel.

* * * * *